US007784521B2

(12) United States Patent
Mullet et al.

(10) Patent No.: US 7,784,521 B2
(45) Date of Patent: Aug. 31, 2010

(54) TENSIONING TOOL FOR A COUNTERBALANCE SYSTEM FOR SECTIONAL DOORS

(75) Inventors: Willis J. Mullet, Gulf Breeze, FL (US); Kelly Ray Green, Jay, FL (US); Thomas B. Bennett, III, Wooster, OH (US)

(73) Assignee: Overhead Door Corporation, Lewisville, TX (US)

( * ) Notice: Subject to any disclaimer, the term of this patent is extended or adjusted under 35 U.S.C. 154(b) by 93 days.

(21) Appl. No.: 12/283,806

(22) Filed: Sep. 16, 2008

(65) Prior Publication Data

US 2009/0014131 A1 Jan. 15, 2009

Related U.S. Application Data

(62) Division of application No. 10/790,447, filed on Feb. 26, 2004, now abandoned.

(51) Int. Cl.
*E05F 11/00* (2006.01)

(52) U.S. Cl. ..... 160/201; 160/191; 160/315

(58) Field of Classification Search ..... 160/191, 160/192, 315, 201, 318; 49/200; 185/39, 185/44; 16/197, 198
See application file for complete search history.

(56) References Cited

U.S. PATENT DOCUMENTS

| | | | | |
|---|---|---|---|---|
| 3,979,977 A | | 9/1976 | Dorma | 81/57.13 |
| 4,253,350 A | | 3/1981 | De Tarr | 81/3 R |
| 4,976,159 A | | 12/1990 | Snyder et al. | 73/862.21 |
| 4,981,165 A | | 1/1991 | Miller et al. | 160/191 |
| 5,419,010 A | | 5/1995 | Mullet | 16/198 |
| 5,501,107 A | | 3/1996 | Snyder et al. | 73/862.23 |
| 5,565,855 A | | 10/1996 | Knibbe | 340/825.6 |
| 5,605,079 A | | 2/1997 | Way | 81/61 |
| 5,615,723 A | | 4/1997 | Carper | 160/191 |
| 5,632,063 A | * | 5/1997 | Carper et al. | 16/198 |
| 5,636,678 A | | 6/1997 | Carper et al. | 160/191 |
| 5,751,224 A | | 5/1998 | Fitzgibbon | 340/825.22 |
| 5,793,300 A | | 8/1998 | Suman et al. | 340/825.2 |
| 5,838,226 A | | 11/1998 | Hougy et al. | 340/310.01 |
| 5,865,235 A | | 2/1999 | Krupke et al. | 160/191 |
| 5,905,442 A | | 5/1999 | Mosebrook et al. | 340/825.06 |
| 5,911,797 A | | 6/1999 | Trevorrow et al. | 81/176.1 |
| 5,926,106 A | | 7/1999 | Beran et al. | 340/825.31 |
| 5,964,268 A | * | 10/1999 | Carper et al. | 160/191 |
| 5,969,637 A | | 10/1999 | Doppelt et al. | 340/825.69 |
| 6,078,271 A | | 6/2000 | Roddy et al. | 340/825.72 |
| 6,125,582 A | | 10/2000 | Mondragon et al. | 49/200 |
| 6,134,835 A | | 10/2000 | Krupke et al. | 49/200 |
| 2003/0230389 A1 | * | 12/2003 | Savard et al. | 160/133 |

* cited by examiner

*Primary Examiner*—Blair M. Johnson
(74) *Attorney, Agent, or Firm*—Renner Kenner Greive Bobak Taylor & Weber

(57) ABSTRACT

A door system (10) including, a door (D) movably mounted on a track assembly (15), a counterbalance system (20) connected to the door and having at least one spring (25), a tool adapter (26) proximate at least one end of the counterbalance system, a detachable winding assembly (30) adapted to selectively engage and selectively rotate the tool adapter to adjust tensioning of the spring, and a locking assembly (36) interacting with the counterbalance system to maintain a selected tensioning of the counterbalance system upon detaching the winding assembly from the tool adapter.

16 Claims, 10 Drawing Sheets

TENSIONING TOOL FOR A COUNTERBALANCE SYSTEM FOR SECTIONAL DOORS

CROSS REFERENCE TO RELATED APPLICATION

This is a divisional application of application Ser. No. 10/790,447 filed Feb. 26, 2004, now abandoned which is incorporated herein by reference.

TECHNICAL FIELD

The present invention relates generally to a tool for tensioning the biasing member in a counterbalance system for a movable barrier such as a sectional door. More particularly, the present invention relates to a tensioning tool having a counter that displays the number of turns of applied or removed tension in a biasing member of a counterbalance system. Most particularly, the present invention relates to a removable tool that mates with a counterbalance system of a sectional door and has a counting assembly adapted to monitor and display the amount of tension applied to the counterbalance spring.

BACKGROUND OF THE INVENTION

Sectional garage doors typically include a counterbalance system that compensates for the weight of the garage door to require a substantially uniform force to move the door throughout its travel between a closed position and an open position, such that the door may be opened with ease and closed without slamming the door to the floor. Counterbalancing is commonly accomplished with extension or torsion springs that are coupled to the door, as by cables, during installation. Torsion springs are conventionally tensioned by winding. This operation is often performed manually, as by inserting winding bars into spring perches to effect rotation. As will be appreciated, this operation can be dangerous, and, thus, various devices have been designed to reduce the danger of tensioning the springs.

One known design employs a power tool having a rotatable drive member mounted on a casing carrying a power transmitting structure. The drive member has a slot with an open end for accommodating the shaft of the counterbalancing mechanism and a releasable coupling structure that connects the drive member with a collar attached to the counterbalance spring, such that rotation of the drive member applies a rotational force to the spring. In this way, a motor within the power transmitting structure is used to drive the collar and tension the spring. A socket or pipe adapter may be connected to the drive member to allow the power tool to rotate nuts, bolts and pipes. While this device can be provided to an installer for multiple uses and does not need to be shipped with each door, not all doors, such as do-it-yourself doors, are installed by a professional installer making this device expensive for a single use. The device is rather heavy and bulky and includes a significant number of components making it expensive to ship with each door, leaving the do-it-yourself consumer to manually tension the counterbalance spring.

Another known design consists of a collar that can be slipped over a rod around which the counterbalance spring is wound, fitted with a pair of ratcheting mechanisms and a device to hold the same in place while the ratchets are used. The device also includes a boss for hooking into the spring collar and applying the correct tension through the use of the ratcheting arrangement. Means for attaching the collar to one end of the spring are provided and, thus, the spring is tensioned through use of the ratcheting mechanism.

Another known device includes a tool for applying rotational force to a coiled torsion spring of a door counterbalancing mechanism. The tool includes a split housing fixedly mounted on the winding cone of the torsion spring. This housing has a sprocket mounted thereon. On either side of the sprocket are annular grooves that respectively connect to a right hand operated and left hand operated ratchet tool. These ratchet tools are to be used sequentially in unison to create tension within the spring.

Still another design is an arrangement for an overhead garage door that includes an adapter used for tensioning the coil spring. The adapter has a body that may be mounted on a rotatable shaft that supports the coil spring and be non-rotatably attached to the end of the coil spring and the rotatable shaft. The attachment to the shaft is a releasable connection and the body has splines or projecting abutment surfaces so that two wrenches may have their jaws closely surround and engage the splines on the body. The wrenches have releasable latches that are designed to engage and disengage the splines on the adapter body. To tension the door, the splines are engaged and rotated with the wrenches in an alternate manner.

With the previously discussed designs, it is not practical to ship the specialized tools with each door. Also, when performing maintenance on doors, these specialized tools may be lost and require replacement when the springs need retensioning. Also, excessive wear may make it impossible to use the specialized tools to retention the spring. As a further practical consideration, these tools are normally used when one is standing on a ladder and tools that are bulky or require two hands to operate make it difficult to maintain one's balance on a ladder, thereby resulting in a safety concern.

Another approach to tensioning such counterbalance systems contemplates a wormgear/worm reducer that allows use of an electric power tool, such as a drill motor, to adjust tension in the spring. Such devices are normally made integral with the counterbalance system. The cost of the winding components adds significantly to the overall cost of the door, thereby making the system more expensive than doors with conventional counterbalance systems. While these systems are very capable of tensioning the door, they lack the physical feedback of the door tension found in the manually operated devices. Consequently, such winding devices need a counter that indicates the applied or removed tension without adding significant cost to the door. As a further disadvantage, since these mechanisms are normally integral with the counterbalance system, they may not be used to tension different doors. Therefore, there is a further need for a system that may be used on many different doors.

One known example of a counterbalance mechanism having a worm-gear assembly for a sectional garage door includes an elongated shaft mounted above the door opening and supporting spaced apart cable drums connected to respective cables that transmit a counterbalance force to the door. Opposing torsion springs are connected to the cable drums at one end and hub members at the other end that are axially slidable but non-rotatable relative to the shaft. The drums are provided with detachable bushing members for engagement with support brackets. The shaft is connected to a non-reversible worm-gear drive at one end. The worm-gear drive may be actuated to selectively vary the torsional winding of the counterbalance springs by rotating the worm and ring gear meshing therewith. The worm-gear drive may be detachably mounted on one or other end of shaft support brackets and a lock plate is supported on the shaft and engagable with the bracket to prevent rotation of the shaft when the mechanism is removed. Spring biased rollers are provided to compensate for skewing of the door caused by the shaft loading both springs which do not have identical characteristics.

Yet another known worm-gear counterbalance system includes a tubular shaft mounted on wall brackets carrying spaced apart cable drums operable to wind counterbalance cables thereon and counterbalance the weight of the door. Torsion springs inner connect with the cable drums and a spring winder tube is sleeved over the springs and connected to the wall brackets by a winding mechanism. The winding mechanism includes a support plate having spaced apart tabs adapted to register in corresponding slots formed in the wall bracket. The winding mechanism further includes a worm-gear drive including a ring-gear which is connected to one end of the winder tube by arrangement of radially inward projecting key portions and a bore of the ring gear, which register with axial grooves formed in the winder tube and are adapted to slide into transverse slots intersecting the grooves. A removable lock pin is engagable with the ring-gear or the worm of the worm-gear drive.

In still another worm-gear counterbalance system design, similar to the previously described design, spring winding and protected cover tubes are sleeved over the springs and connect to support brackets by a worm-gear drive winding mechanism. The worm-gear drive winding mechanism rotates the tubes to effect winding of the torsion coil springs through hub assemblies but prevents rotation of the tubes during normal operation of the counterbalance system. The cable drums and spring hub assemblies may be supported on an elongated synchronizing shaft or torque transfer shaft extending between and supported on the wall brackets.

SUMMARY OF THE INVENTION

It is an object of the present invention to provide an improved tensioning tool for winding a counterbalance spring in a sectional door system. Another object of the present invention is to provide such a tool that includes a counting assembly indicating the amount of tension applied or released from the counterbalance spring. It is another object of the present invention to provide such a tool that may be used in connection with a non-powered or powered wrench or driver.

It is still another object of the present invention to provide a tensioning tool that will accommodate a plurality of door heights. Yet another object of the present invention is to provide such a tool that is easily attachable to and detachable from a counterbalance system. Another object of the present invention is to provide a tensioning tool that may be used to wind either the right or left hand wound springs of a counterbalance system. Still another object of the present invention is to provide such a tool that can be used to wind torsion or extension springs. Yet another object of the present invention is to provide such a tool that provides tension turn count for both winding and unwinding springs. A further object of the invention is to provide such a tool which has a housing with a stop operable independent of the counterbalance support bracket to prevent rotation of the tool during tensioning of the counterbalance system by engaging the door frame or hardware overlying the door frame by virtue of the relative sizing and/or positioning of the counterbalance system, the tool and the door frame.

In light of at least one of the foregoing objects, the present invention provides a door system including, a door movably mounted on a track assembly, a counterbalance system connected to the door and having at least one spring, a tool adapter proximate at least one end of the counterbalance system, a detachable winding assembly adapted to selectively engage and selectively rotate the tool adapter to adjust tensioning of the spring, and a locking assembly interacting with the counterbalance system to maintain a selected tensioning of the counterbalance system upon detaching the winding assembly from the tool adapter.

DETAILED DESCRIPTION OF THE INVENTION

Figure 1:
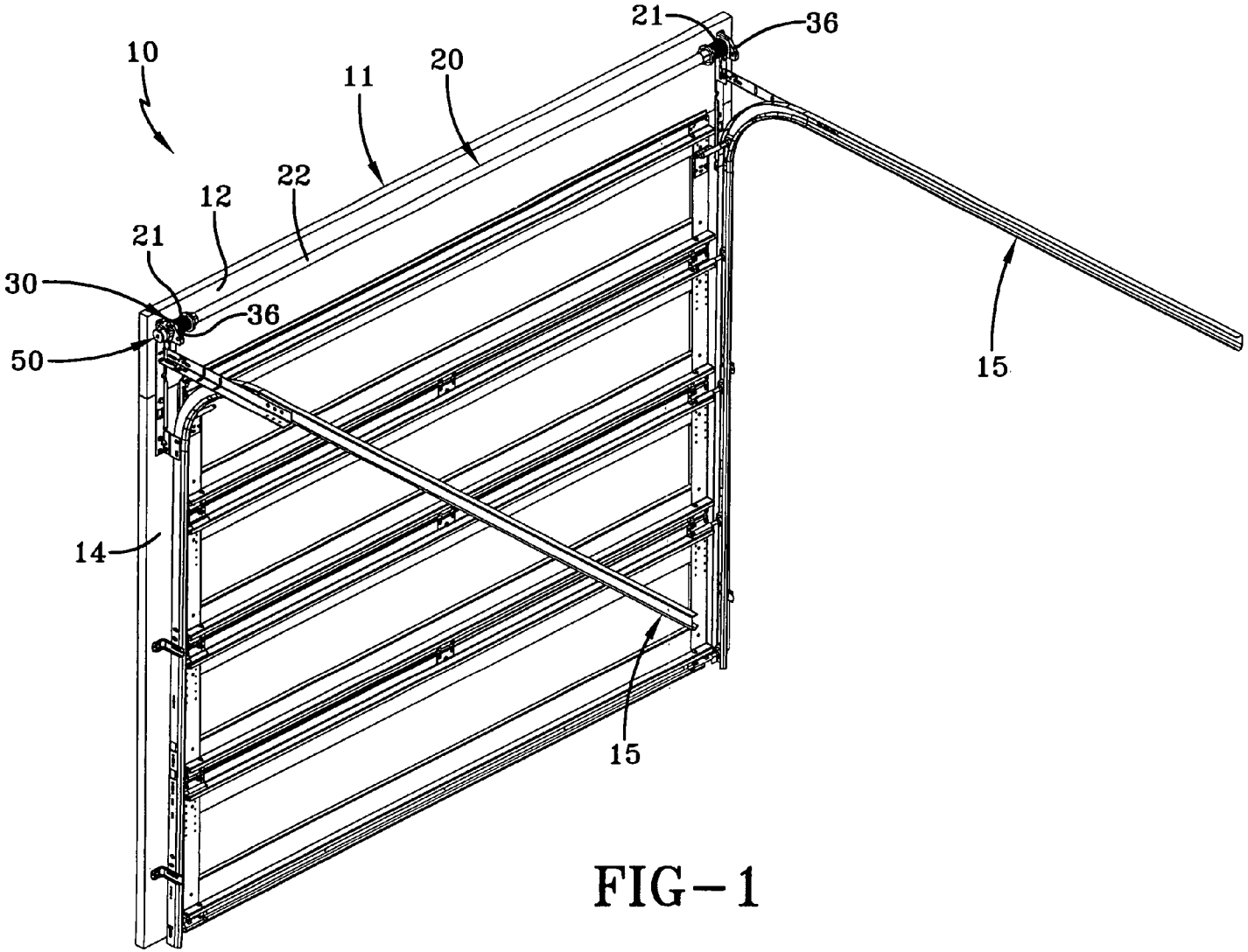
FIG. 1 is a rear perspective view of an overhead garage door system supported on a pair of rails and operatively attached to a counterbalance system having a tensioning tool according to the concepts of the present invention mounted thereon.

A tensioning tool according to the concepts of the present invention is shown in the accompanying Figs., and generally indicated by the letter T. The tensioning tool T is used in connection with a door system, generally indicated by the numeral 10, that is mounted to a framework, generally indicated by the numeral 11, made up of a header 12 and a pair of spaced vertical jambs 14. The door system 10 includes guide tracks, generally indicated by the numeral 15, which receive a door D, movably mounted thereon. The framework 11 defines an opening in which the door D is selectively moved from a closed vertical position depicted in FIG. 1, to an open horizontal position (not shown), where the door D is retracted from the opening. In general, door D may be an upwardly acting door, such as the sectional door shown by way of example in the Figs. It will be understood that the tensioning tool T of the present invention may be used with other known door systems.

In the example shown, door system 10 includes a counterbalance system, generally indicated by the numeral 20, used to offset the weight of the door D. Counterbalance system 20 is shown mounted on the header 12 and includes a pair of cable drums 21 carried on an axle 22, which may be in the form of a solid shaft or hollow tube, rotatably supported on support brackets 24. The cable drums 21 carry a cable C used to couple the door D to the counterbalance system 20 in a manner well known in the art.

To facilitate raising and lowering of the door D, the counterbalance system 20 may include a counterbalance spring 25 (FIG. 10) constructed of a suitable resilient material, for example, steel, for applying to the door D via cable C. As shown, counterbalance spring 25 may be a coil spring located generally coaxially with and housed within axle 22. Alternatively, counterbalance spring 25 may be located externally of the axle 22 and coiled around the axle 22. In either instance, the end of spring 25 remote from adjacent cable drum 21 is non-rotatable relative to axle 22. To apply tension to the spring 25, counterbalance system 20 includes a tool adapter 26 that is nonrotatably connected to the proximate end of spring 25 and that receives a tensioning tool T and through which the tensioning force is applied to the spring 25. The tool adapter 26 may take the form of a recess or hole into which a tool is nonrotatably received or other external surfaces against which a tool may bear. The exemplary counterbalance system 20 depicted herein is substantially in accordance with that shown in U.S. Pat. No. 5,419,010, which is incorporated herein by reference.

Figure 4:
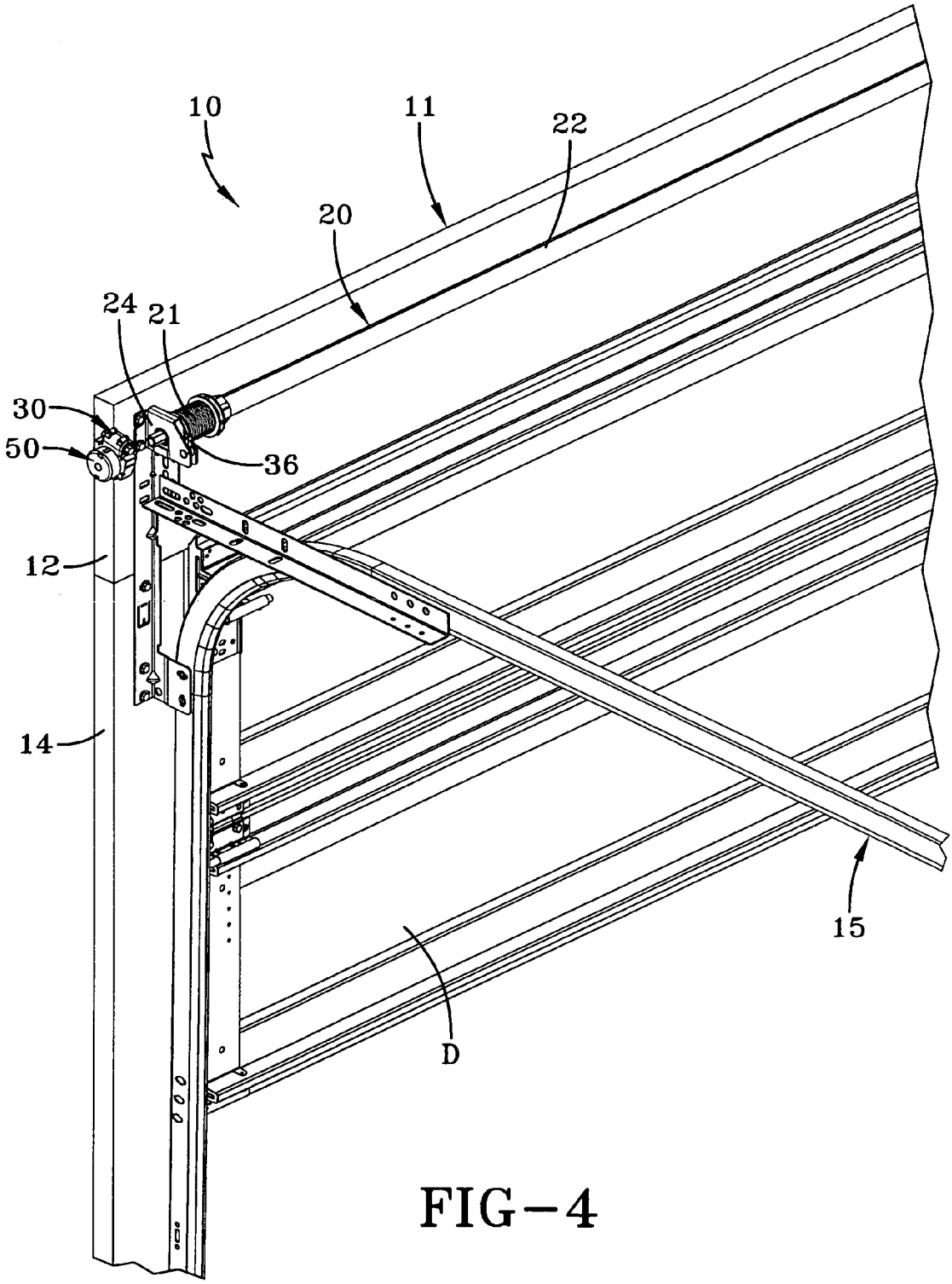
FIG. 4 is an enlarged fragmentary perspective view of the door system of FIG. 1 with the tensioning tool shown detached from the counterbalance system.
Figure 5:
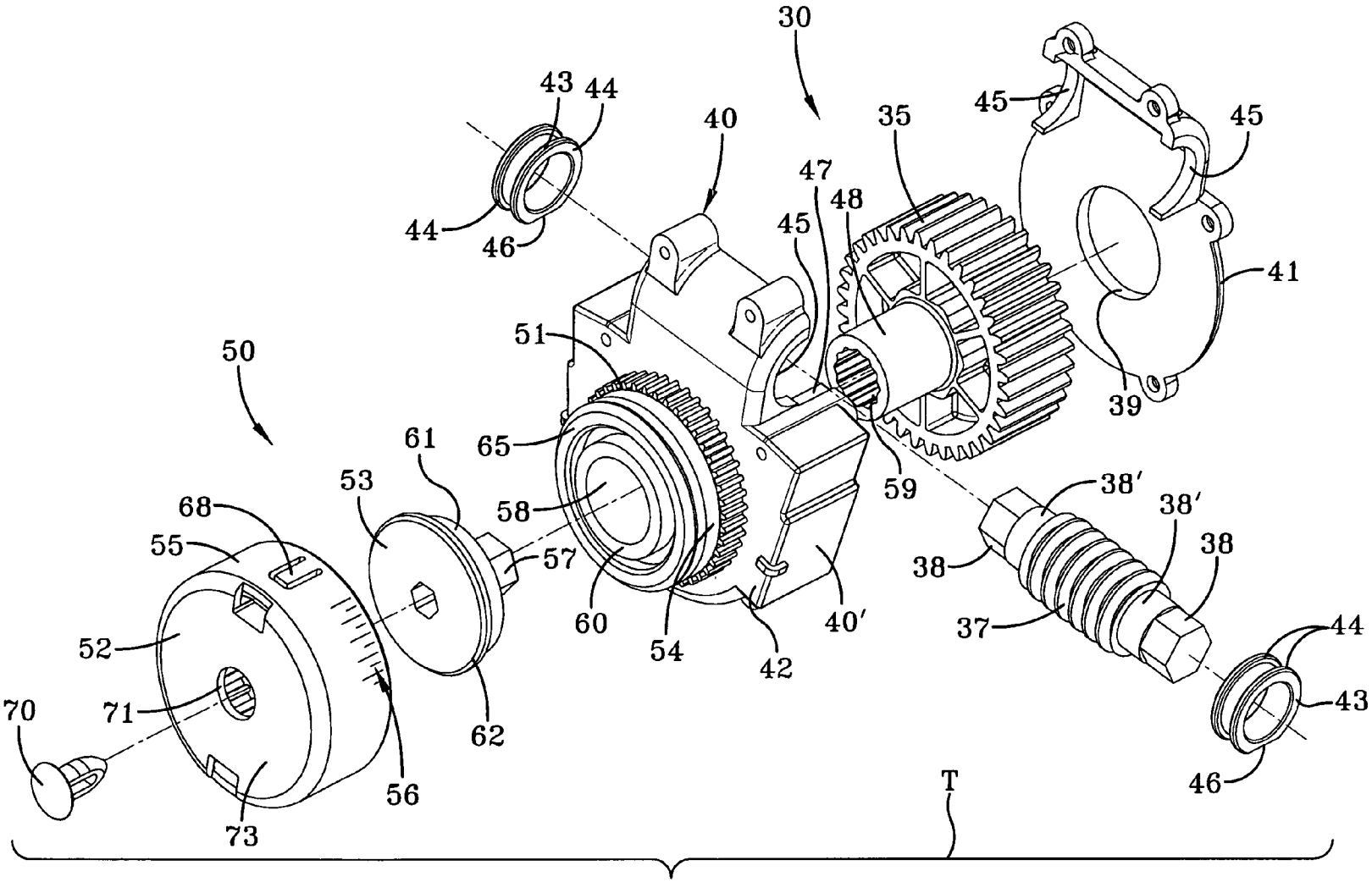
FIG. 5 is a left side exploded perspective view of the tensioning tool of FIG. 1.
Figure 6:
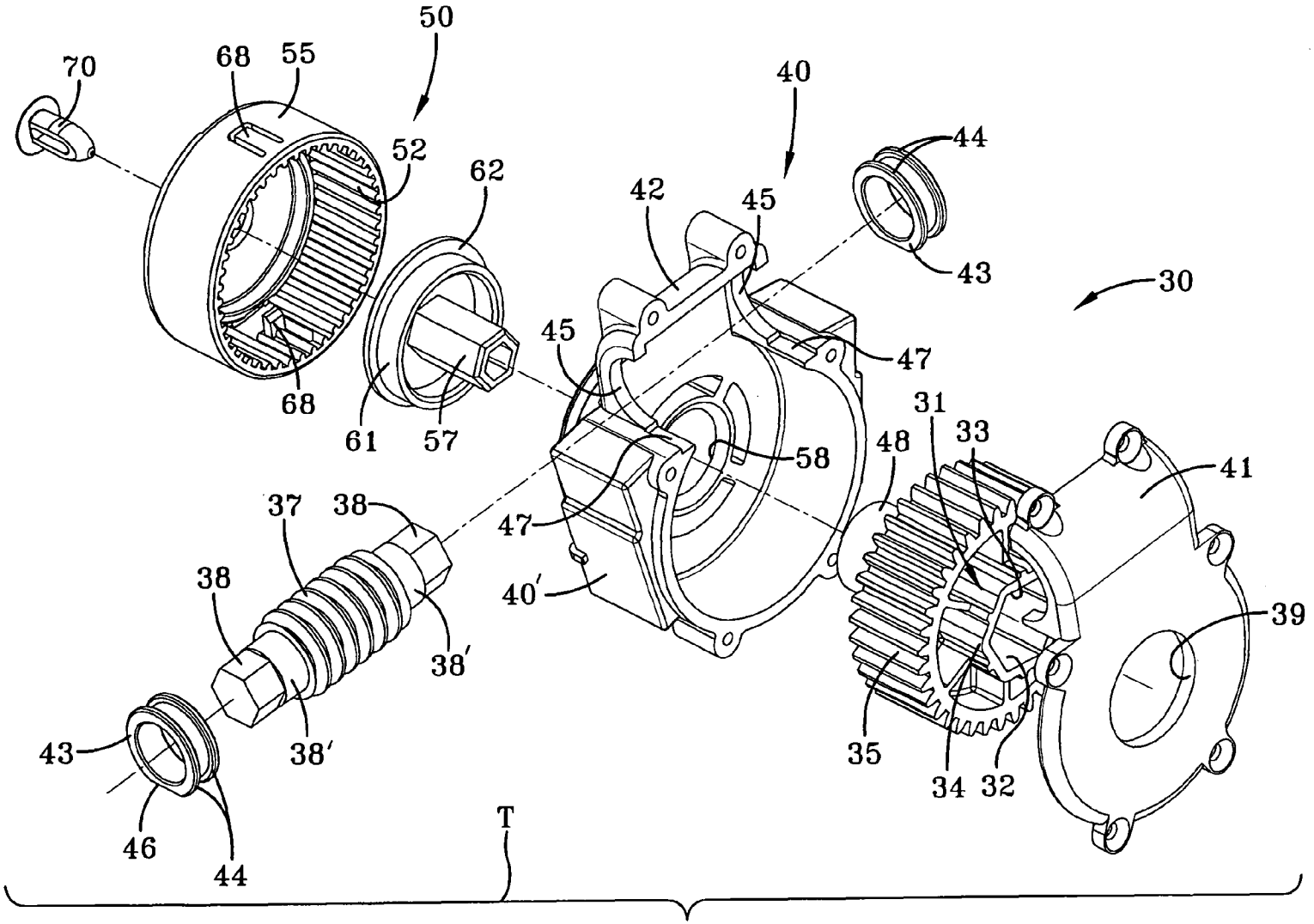
FIG. 6 is a right side exploded perspective view of the tensioning tool of FIG. 1.
Figure 7:
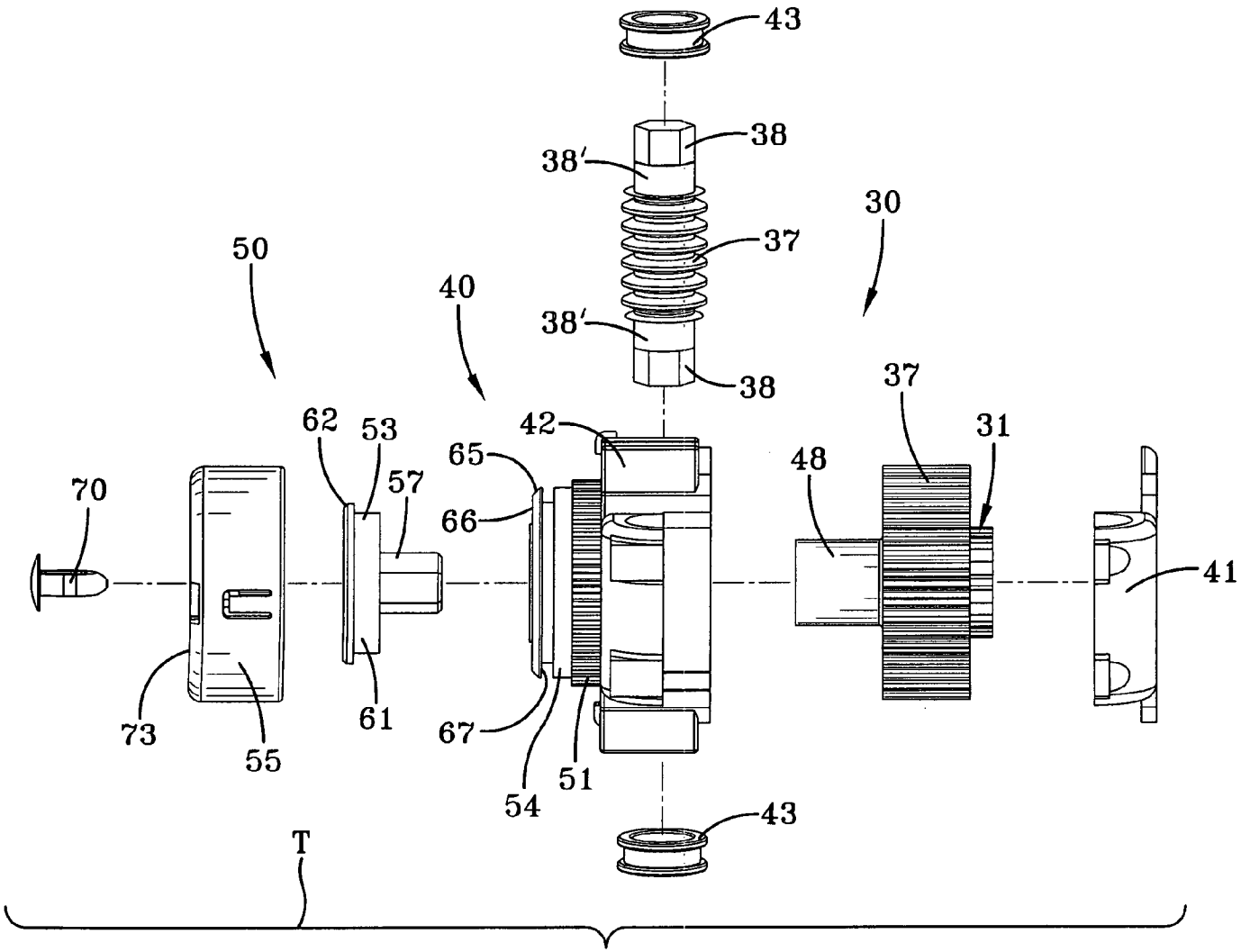
FIG. 7 is an exploded top plan view of the tensioning tool of FIG. 1.

The tensioning tool T has a winding assembly, generally indicated by the numeral 30, that may be configured to operate with tool adapter 26 to adjust the tension on counter balance spring 25 (FIGS. 5-7). To that end, winding assembly 30 is removably attached to the counter balance system 20 by a coupler, generally indicated by the numeral 31, that interfaces with the tool adapter 26 allowing the winding assembly 30 to apply tension to the spring 25. For example, in the embodiment shown, the counterbalance system 20 has a tool adapter 26 that projects laterally outward of support bracket 24 attached to an angle iron 24' affixed to header 12. This tool adapter 26 has a hexagonal external surface to which a tool may be applied. The coupler 31 of winding assembly 30 includes a bore 32 defining at least one tool adapter engaging surface 33 that rotationally couples the winding assembly 30 to the tool adapter 26 (FIG. 6). In the embodiment shown, a hexagonal shaped bore 32 is defined by the hub 34 of a first gear 35 within the winding assembly 30. In this example, the winding assembly 30 is attached to or selectively installed on the counterbalance system 20 by sliding the winding assembly 30 onto the tool adapter 26. It will be appreciated that the winding assembly 30 may be slidably removed after the tensioning operation is complete, as depicted in FIG. 4, and a pawl and ratchet locking mechanism 36 is engaged to maintain the selected tensioning (FIG. 4).

Figure 10:
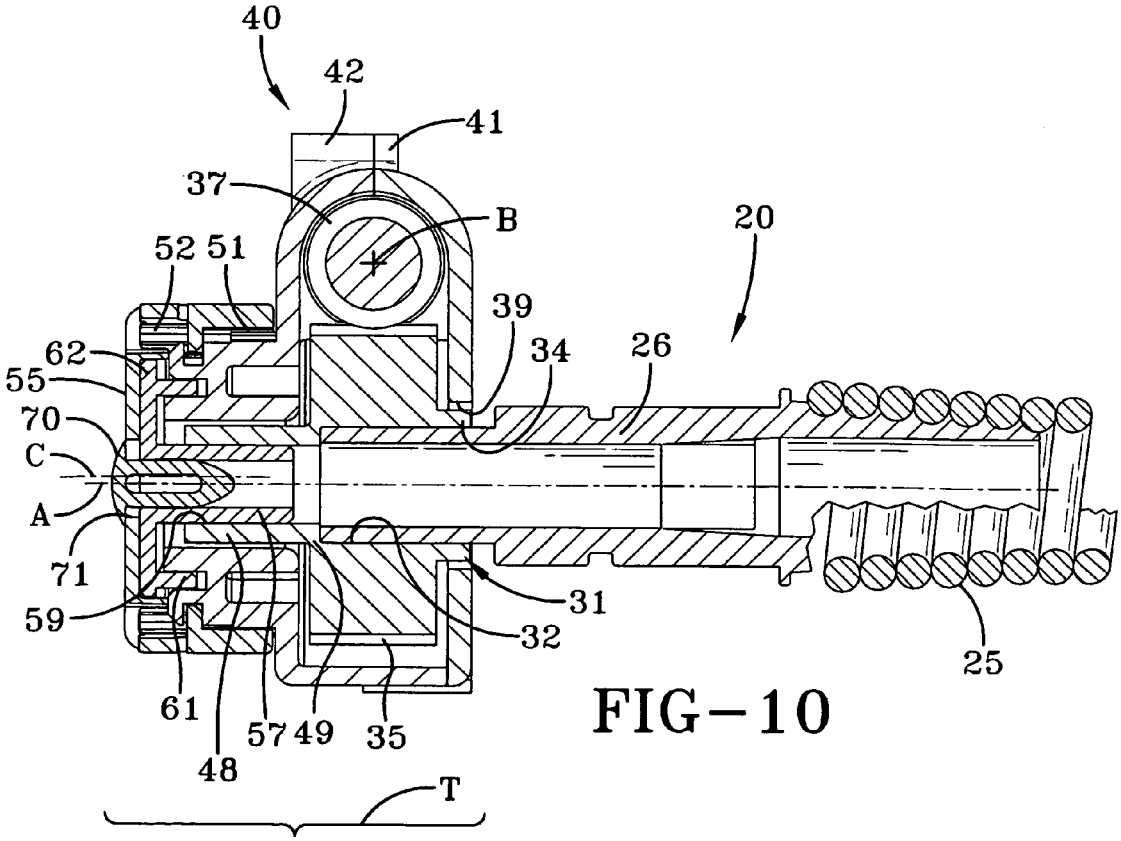
FIG. 10 is a cross-sectional view taken substantially along line 10-10 of FIG. 9 of the tensioning tool and a portion of the counterbalance system with the tensioning tool in the installed operative position.

With the winding assembly 30 coupled to the counterbalance spring 25, tensioning of the spring 25 may be performed by rotating the tool adapter 26. To that end, the first gear 35 is rotatably mounted within a housing, generally indicated by the numeral 40, and has a first axis of rotation A corresponding to that of the tool adapter 26 (FIG. 10). The housing 40 has an opening 39 through which the tool adapter 26 may extend into the coupler 31 on first gear 35. First gear 35 may be used to turn the tool adapter 26 in either direction about axis A. The first gear 35 may be driven by a second gear 37, which may be a worm gear. By using a worm gear, the second axis of rotation B of the second gear 37 may be made perpendicular to the first axis of rotation A of the first gear 35. In this instance, the second gear 37 is rotatable about an axis that extends rearward of the door D.

Figure 2:
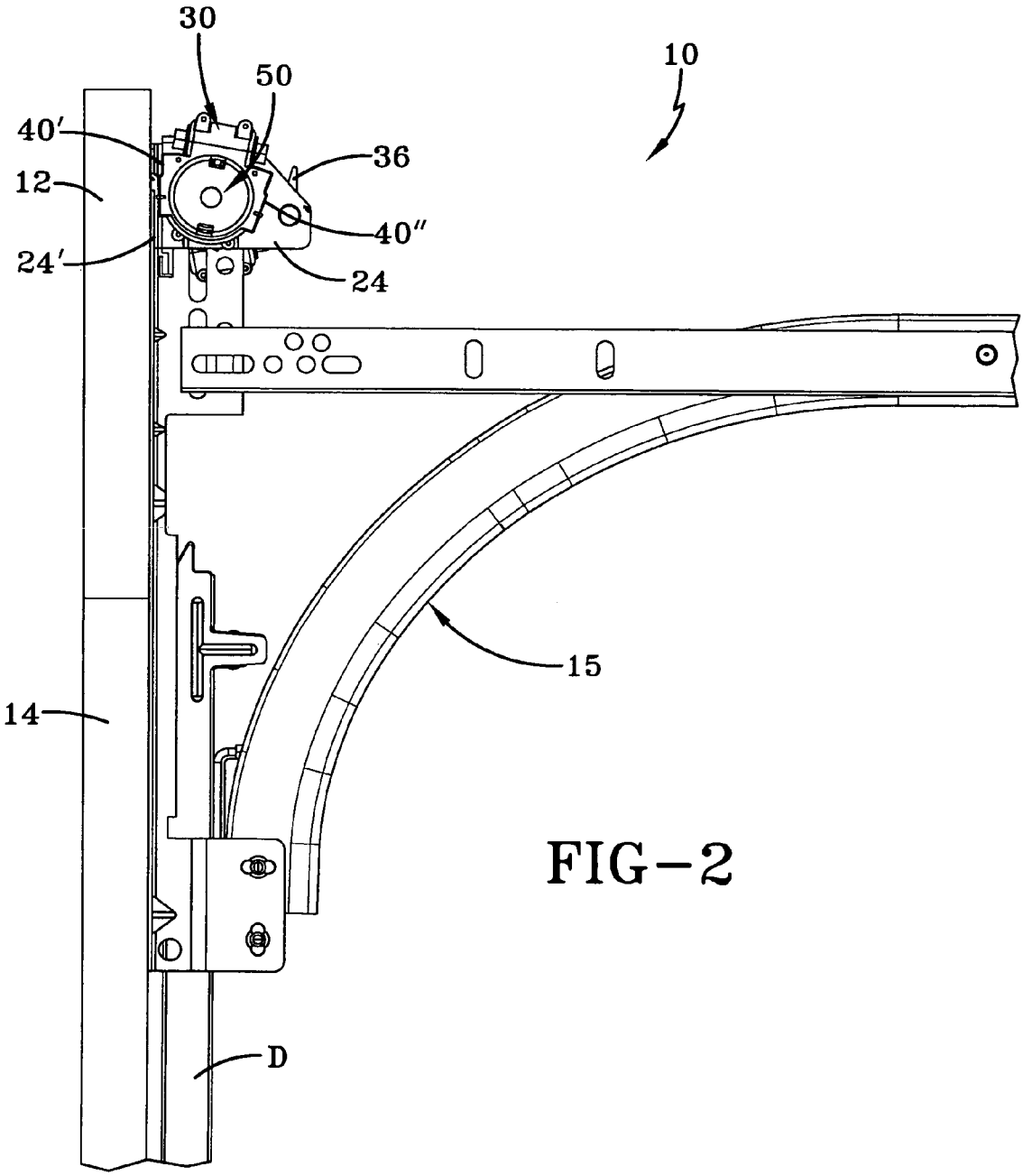
FIG. 2 is an enlarged fragmentary left side elevational view of the door system of FIG. 1 showing the tensioning tool mounted on the counterbalance system for tensioning a counterclockwise wound spring.
Figure 3:
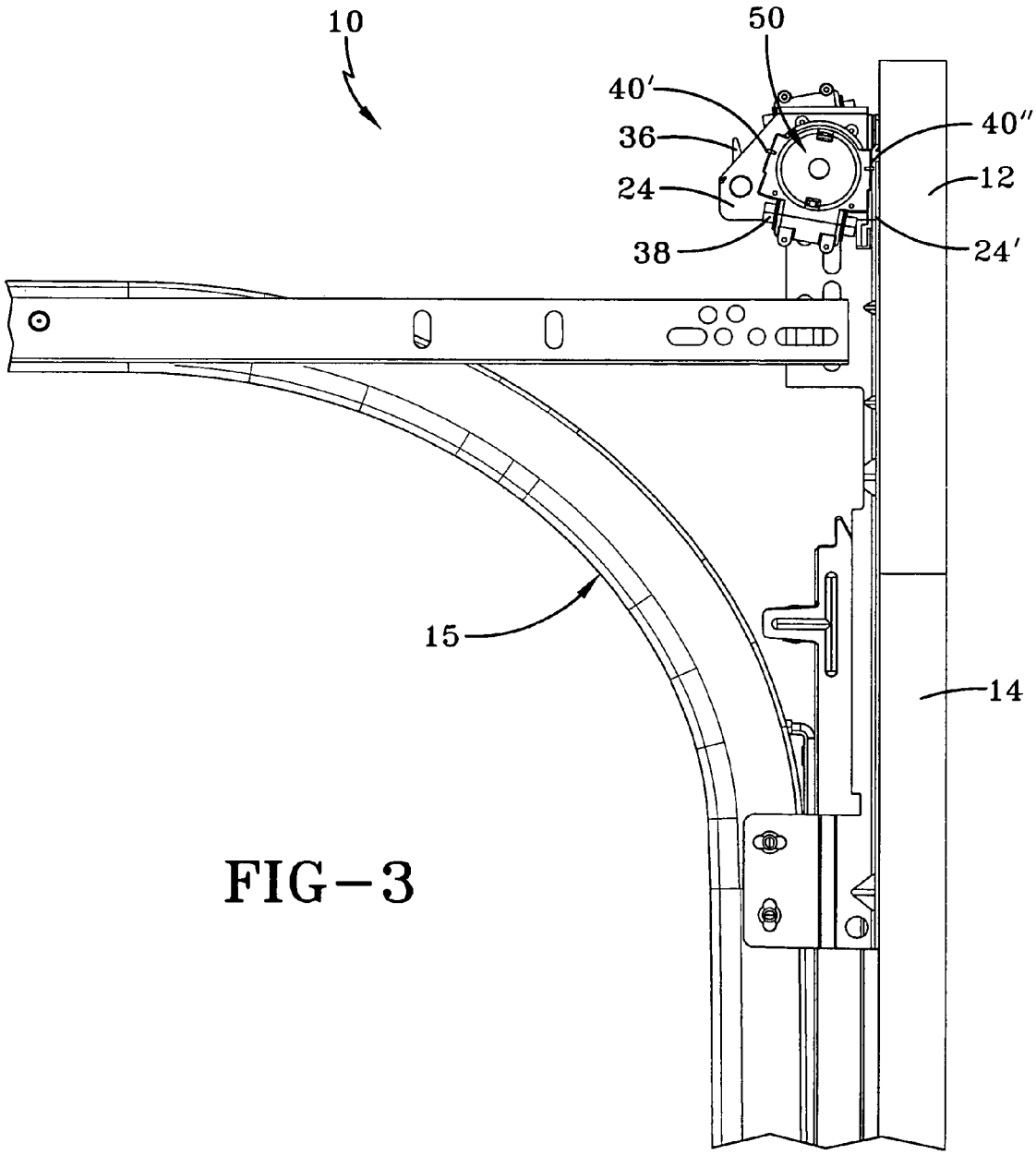
FIG. 3 is an enlarged fragmentary right side elevational view similar to FIG. 2 showing the tensioning tool mounted on the counterbalance system for tensioning a clockwise wound spring.

The second gear 37 includes at least one boss 38 adapted to couple the second gear 37 to a standard tool, such as a drill or driver. For example, a hexagonal boss 38 may extend from one or both ends of the second gear 37. With a boss 38 located at both ends of second gear 37, the winding assembly 30 may be attached at either the left end or right end side (FIG. 1) of the counterbalance system 20 (FIGS. 2 and 3) and conveniently provide a rearward facing boss 38, i.e., facing the installer, onto which tensioning tool 50 may be attached. Thus positioned, one of stop surfaces 40' and 40" of housing 40 engages angle iron 24' to prevent rotation of housing 40 during a tensioning operation. As shown in FIG. 2, stop surfaces 40' and 40" may be sloped to cause the rearward facing boss 38 to angle downward (FIG. 2) or upward (FIG. 3) to make the boss 38 even more accessible to the installer. In the example shown, stop surfaces 40' and 40" slope inward as they extend downwardly as the housing 40 is oriented as shown in FIG. 2. Since the right end of the counterbalance system 20 is a mirror image of the left side, the following exemplary description covers only the left end of counterbalance system 20.

The second gear 37 is mounted such that it operatively interacts with the first gear 35 to cause rotation thereof in either a clockwise or counterclockwise direction and like the first gear 35 is rotatably mounted within the housing 40. As shown, cylindrical surfaces 38' at either end of the second gear 37 may be received within bushings 43 mounted on the housing 40. While the bushings 43 may be integrally formed with the housing 40, as shown in the drawings, removable bushings 43 may be used such that they may be easily replaced in the event of damage or wear. In the example shown, a pair of substantially annular bushings 43 are provided. Bushings 43 may have radially outward extending flanges 44 formed at each end thereof and axially spaced from each other to seat the bushings 43 within a generally circular ribs 45 that extend from the housing 40. The bases 46 of bushings 43 may be flattened and fit within recesses 47 formed in housing 40 to prevent rotation of bushing 43. As shown, the housing 40 may be formed in two pieces 41, 42 that are joined to encompass the bushings 43 therebetween. When the two pieces 41, 42 of housing 40 are joined, the first gear 35 and second gear 37 are enclosed and maintained in meshing engagement. The bosses 38 extends axially outwardly of bushings 43 and are readily accessible for tensioning spring 25. It will be appreciated that the bosses 38 need not extend outside of the housing 40 and may be accessible through an opening in the housing 40.

Figure 8:
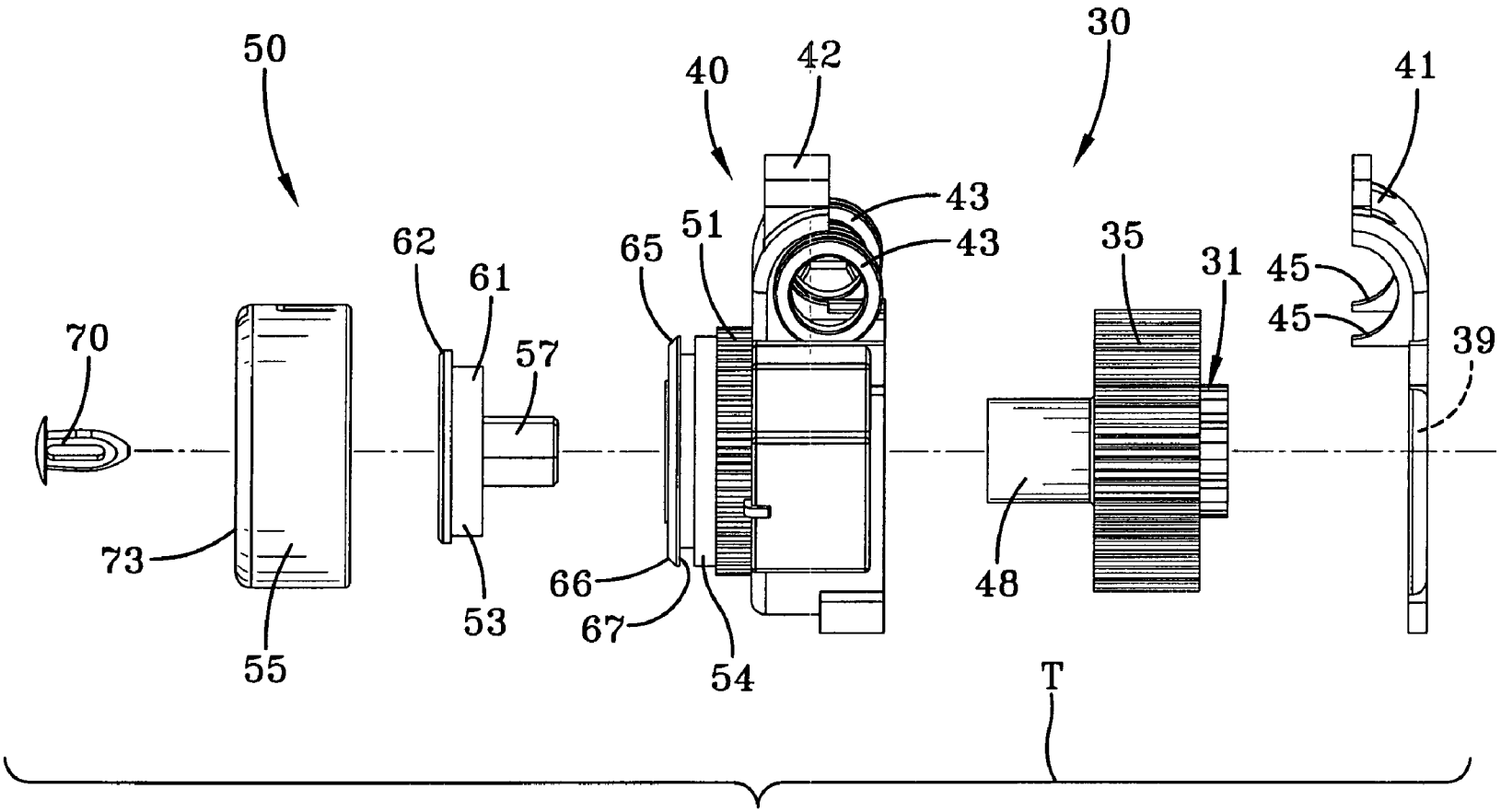
FIG. 8 is an exploded front elevational view of the tensioning tool of FIG. 1.
Figure 9:
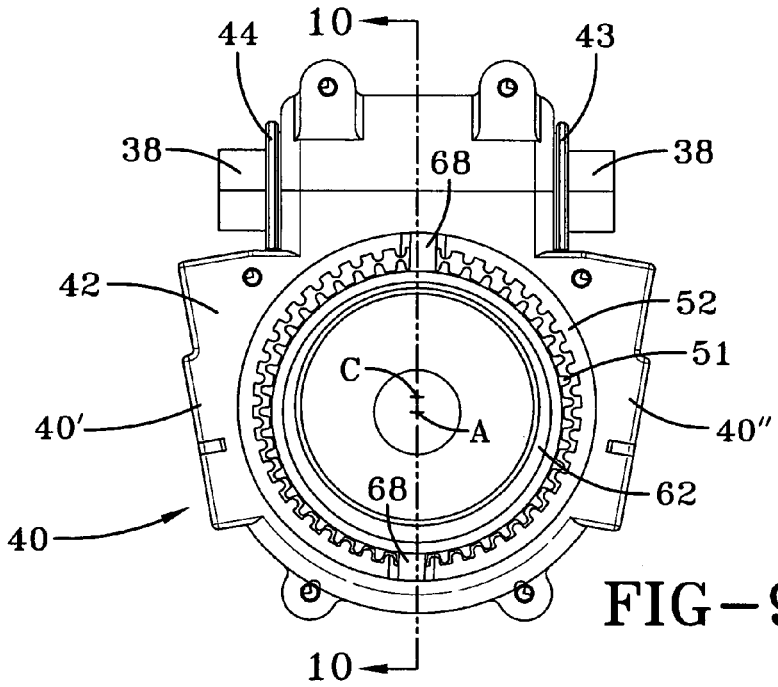
FIG. 9 is an enlarged side elevational view of the tensioning tool of FIG. 1 with portions broken away to show details of the gear arrangement.

A counter assembly according to the concepts of the present invention, generally indicated by the numeral 50, which may be part of tensioning tool T, is operable with the winding assembly 30 to quantify the tension on the counterbalance system 20 and convey that information to the user. With reference to FIGS. 1-10, a mechanical counter assembly 50 is shown used in connection with the winding assembly 30. Counter assembly 50 rotates in an incremental fashion proportionate to one revolution of first gear 35, as will be described more completely below. With reference to FIGS. 7 and 8, counter assembly 50 may include a fixed gear 51, a rotating gear 52 and a counter cam 53. The fixed gear 51 may be formed on an outer surface 54 of housing 40. As best seen in FIG. 6, the rotating gear 52 may be formed on the interior surface of a rotatable counter 55 that when assembled with housing 40, shrouds the fixed gear 51 with the rotating gear 52. As best shown in FIG. 9, the gears 51, 52 are configured in a missing-tooth configuration, whereby the fixed gear 51 has one less tooth than the rotating gear 52. Further, the pitch diameter of the rotating gear 52 is slightly larger than the pitch diameter of the fixed gear 51, such that a complete revolution of the counter cam 53 signifying one revolution of tension on counterbalance spring 25 will rotate the rotating gear 52 a circumferential distance of one tooth on the fixed gear 51. A counter cam 53 is rotatably coupled to first gear 35 of winding assembly 30, such that the counter cam 53 and tool adapter 26 rotate in a one-to-one relationship. Thus, an appropriate scale 56 may be coupled to the counter 55 as by an adhesive label or engraving forming indicia on the counter 55 to track the number of revolutions of the counter relative to housing 40 (FIG. 5). If desired, a number of counters 55 having different scales 56 may be provided to reflect the appropriate count for doors D of different heights and/or different characteristics of the springs 25. Rotational coupling of the counter cam 53 and first gear 35 may be made in a plug-and-socket fashion by a projection 57 that extends axially inwardly through a bore 58 defined in the fixed gear 51 and housing 40 and into a socket 59 defined in a cylindrical boss 48 extending axially outwardly from the hub 34 of first gear 35. The projection 57 and socket 59 are appropriately sectioned, such that they are rotatably coupled to one another. For example, the projection 57 may have a hexagonal outer surface and the socket 59 within boss 48 may have a similar section with at least one surface adapted to engage the projection 57, such that it rotates in unison with the first gear 35. It will be understood that the location of the projection 57 and socket 59 may be reversed. It will further be understood that boss 48 and coupler 31 may share a common bore. In the example shown in FIG. 10, socket 59 has a smaller radial dimension than bore 32 of coupler 31 defining an annular shoulder 49 that acts as a stop against over-insertion of tool adapter 26 when mounting the winding assembly 30 and counter assembly 50 thereon.

To facilitate rotation of the counter cam 53, an annular collar 60 may extend axially outwardly from the housing 40 surrounding bore 58 and counter cam 53 may include an axially inwardly extending cuff 61 that fits over the collar 60 and is rotatable thereon. Counter cam 53 has a plate like end that includes a flange 62 extending radially outwardly of the cuff 61. As best shown in FIG. 10, flange 62 has a center axis C spaced from the first axis A about which first gear 35 rotates, such that flange 62 rotates in an eccentric manner. The spacing of the center axis C of flange 62 is substantially equal to the difference in the pitch diameters of gears 51,52. Thus, one revolution of counter cam 53 rotates the rotating gear 52 a circumferential distance of one revolution and one tooth of the fixed gear 51.

Flange 62 of counter cam 53, on its inward axial side, abuts a ring 65 located radially outwardly of the collar 60 of housing 40. Ring 65 provides a surface on which the counter 55 may rotate and may define a circular groove 67 located axially inwardly of its axial outer surface 66 that receives detents 68 formed on the interior of the counter 55. In this way, the counter 55 may be snap fit onto ring 65. A pin 70 may be pushed through an opening 71 defined in the center of an endwall 73 of counter 55 and into the counter cam 53 to assure that the counter cam 53 remains in contact with the counter 55.

When assembled, the winding assembly 30 is coupled to the tool adapter 26 of the counterbalancing system 20 and torque is applied to the second gear 37 at boss 38 by means of a powered or nonpowered tool. This results in rotation of first gear 35 and counter cam 53 causing on the one hand the first gear 35 to tension the counterbalance spring 25 and on the other hand the counter cam 53 to wobble the gear teeth of rotating gear 52 over the fixed gear 51, such that, the counter 55 senses and responds by rotating an amount equal to the pitch of the fixed gear 51. The counting function is the same regardless of the direction of rotation. In this way, the amount of tension may be tracked as it is applied or released from the spring 25. This information is displayed in the movement of the counter 55 as reflected by the attached scale 56.

Figure 11:
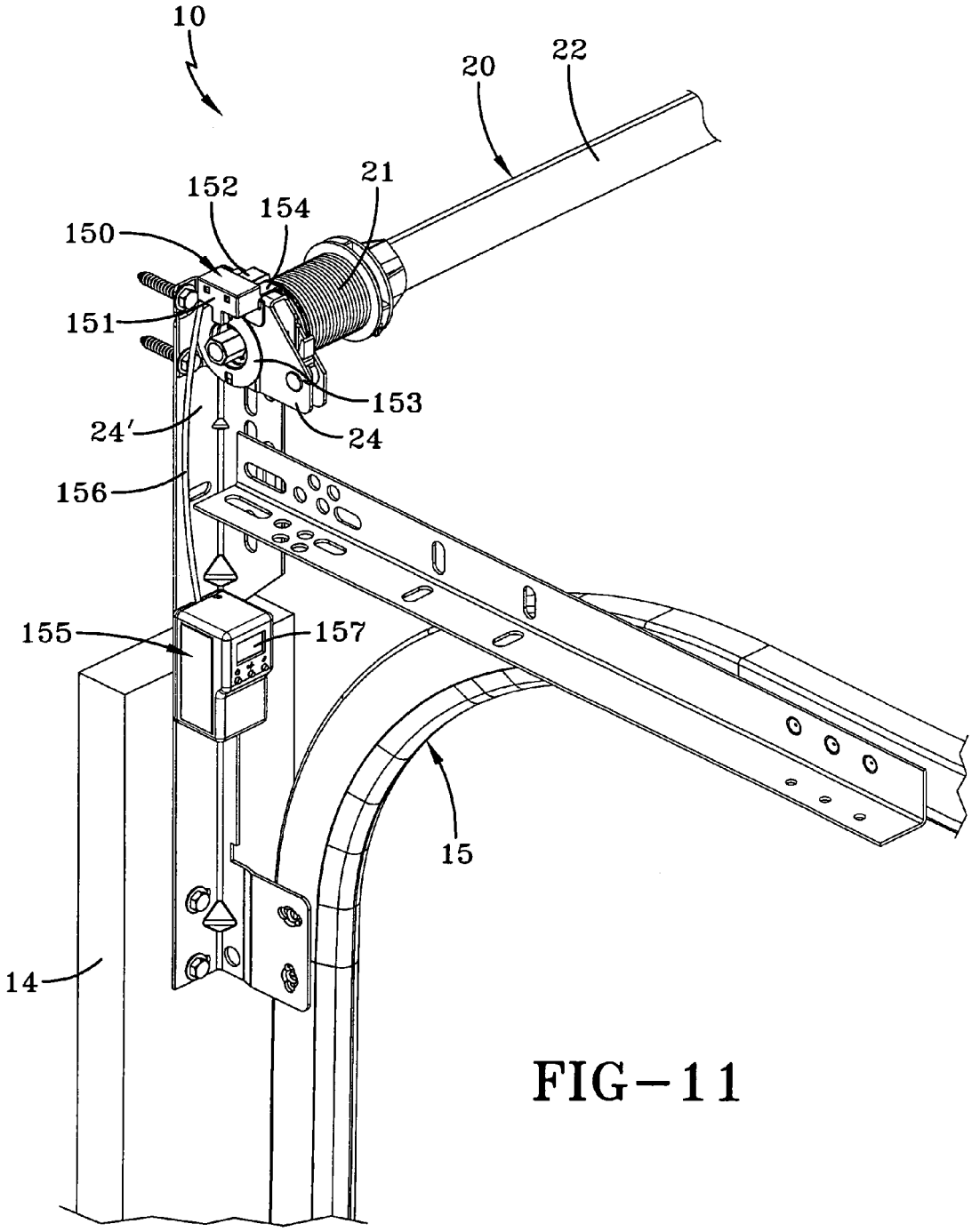
FIG. 11 is an enlarged rear perspective view of a door system similar to that shown in FIG. 1 and depicting a alternate counter according to the concepts of the present invention used in connection with the counterbalance system.

As an alternative to monitoring tension with the mechanical counter 50, tension may be monitored electronically. Referring to FIG. 11, an alternate counter assembly 150 includes a sensor or encoder 151 that is supported adjacent to the counterbalance system 20, for example on support bracket 24. A counter wheel 153 having readable indicia about its circumference is rotatably attached to the tool adapter 26 of the counterbalance system 20, such that it rotates with the tool adapter 26. In a manner well-known in the art, the encoder 151 tracks the revolutions of the counter wheel 153 to determine the amount of tension being applied or released from the spring 25. The encoder 151 is electronically connected to a counter 155 that displays the amount of tension applied to the counterbalance spring 25. The counter 155 may be located remotely from encoder 151 and electrically connected thereto wiring 156. As shown, the counter 155 may include a digital readout window 157. As will be appreciated, the counter 155 may contain a microprocessor to calculate revolutions and/or to calculate a tension value for display at window 157.

To provide for use of the counter assembly 150 with multiple doors, the encoder 151 is removable from the counter balance system 20, and may include a bracket 152 having a downwardly extending ear 154 that is laterally spaced from the encoder 151 to slidably fit over the support bracket 24. Conventionally, the display unit 155 may be held by the user or hung on a fastener or other convenient projection. Thus, when the installer is finished tensioning the door D, the encoder 151 may be slid off the support bracket 24 and the display unit 155 removed therewith.

Thus, it should be evident that the tensioning tool and counters for a counterbalance system for sectional doors disclosed herein carries out one or more of the objects of the present invention set forth above and otherwise constitutes an advantageous contribution to the art. As will be apparent to persons skilled in the art, modifications can be made to the preferred embodiments disclosed herein without departing from the spirit of the invention, the scope of the invention herein being limited solely by the scope of the attached claims.

What is claimed is:

1. A door assembly comprising a door movably mounted on a track assembly, a counterbalance system connected to said door and having at least one spring, a tool adapter proximate at least one end of said counterbalance system, a detachable winding assembly adapted to selectively engage and selectively rotate said tool adapter to adjust tensioning of said spring, and a locking assembly interacting with said counterbalance system to maintain a selected tensioning of said counterbalance system upon detaching said winding assembly from said tool adapter, wherein said winding assembly includes a rotatable housing, a first gear rotatably mounted within said housing having a first axis of rotation positionable coaxial with said tool adapter, said first gear defining a receiver adapted to rotatably fix said first gear to said tool adapter, a second gear operatively interconnected with said first gear to cause rotation thereof, said second gear being rotatably mounted in said housing with a second axis of rotation substantially perpendicular to said first axis of rotation, a boss adapted to receive a driver extending outwardly from said second gear, the door system further comprising a counter assembly having a fixed gear attached to an outer surface of said housing around an opening, a counter cam coupled to said first gear to rotate in unison with said counter cam, and a rotating gear rotatably mounted on said housing and operatively interrelated with said fixed gear, wherein said counter cam has an eccentric profile and engages said rotating gear to rotate said rotating gear a selected circumferential distance for each revolution of said counter cam.

2. A door system according to claim 1, wherein said counter assembly is operatively interrelated with said winding assembly to quantify and display tensioning of said counterbalance system.

3. A door system according to claim 1, wherein said locking mechanism is a pawl and ratchet.

4. The door assembly of claim 1, wherein said circumferential distance is equal to about one revolution and one tooth on said fixed gear.

5. The door assembly of claim 4, wherein said rotating gear is formed on an interior surface of said counter, and a scale is attached to an exterior surface of said counter, wherein said scale is adapted to indicate revolutions of movement of said counter relative to said fixed gear.

6. The door assembly of claim 5, wherein said scale includes a label having indicia thereon.

7. The door assembly of claim 1, wherein said first gear defines a socket coaxial with said receiver, said socket adapted to rotatably fix said counter cam to said first gear, wherein said socket has a reduced radial dimension relative to said receiver defining an annular shoulder engageable with said tool adapter to prevent over-insertion thereof.

8. A detachable tensioning tool in combination with a door system comprising, a door movably mounted on a track assembly, a counterbalance system connected to said door, first and second tool adapters at each end of and coaxial with said counterbalance system and connected to first and second springs, a winding assembly including a rotatable housing and adapted to selectively engage and selectively rotate either of said first and second tool adapters, stop surfaces on said housing on opposite sides of said axis preventing rotation of said housing during tensioning of said counterbalance system, and brackets mounting said counterbalance system and attached to fixed angle irons, wherein said stop surfaces include a first stop surface and a second stop surface, said first stop surface engaging one of said angle irons when said winding assembly engages one of said first and second tool adapters and said second stop surface engaging a second of said angle irons when said winding assembly engages the other of said first and second tool adapters.

9. A detachable tensioning tool in combination with a door system according to claim 8, wherein said stop surfaces engage said angle irons.

10. A detachable tensioning tool in combination with a door system according to claim 8, wherein said winding assembly includes a gear having oppositely projecting driver engaging bosses, one of said driver engaging bosses engageable when said winding assembly is in engagement with said first tool adapter and a second of said driver engaging bosses engageable when said winding assembly is in engagement with said second tool adapter.

11. A detachable tensioning tool in combination with a door system according to claim 10, wherein at least one of said stop surfaces slopes downwardly and inwardly relative to one of said driver engaging bosses.

12. A detachable tensioning tool in combination with a door system comprising, a door movably mounted on a track assembly, a counterbalance system connected to said door, first and second tool adapters at each end of and coaxial with said counterbalance system and connected to first and second springs, a winding assembly including a rotatable housing and adapted to selectively engage and selectively rotate either of said first and second tool adapters, and stop surfaces on said housing on opposite sides of said axis preventing rotation of said housing during tensioning of said counterbalance system, wherein said winding assembly includes a driver engaging boss extending outwardly from said housing along an axis, and wherein at least one of said stop surfaces is adapted to position said housing such that said axis of said driver engaging boss extends rearwardly and downwardly.

13. A detachable tensioning tool in combination with a door system according to claim 12, wherein said counterbalance system has a locking mechanism for maintaining a selected tension in said counterbalance system.

14. A detachable tensioning tool in combination with a door system according to claim 12 further comprising, a counter associated with said winding mechanism to quantify and display tensioning of said counterbalance system.

15. A detachable tensioning tool in combination with a door system according to claim 14, wherein said counter has different indicia for either of said door and said counterbalance system having different characteristics.

16. A detachable tensioning tool in combination with a door system comprising a door movably mounted within a door frame on a track assembly, a counterbalance system connected to said door by support brackets, first and second tool adapters at each end of said counterbalance system connected to first and second springs, a winding assembly including a housing and a coupler adapted to selectively engage and selectively rotate either of said first and second tool adapters, a circumferentially continuous first gear of said coupler having a fixed hub rotatably coupling said winding assembly and said tool adapter, a rotatable second gear of said coupler directly engaging said first gear and accessible for having rotation imparted from exteriorly of said housing, a first stop surface on said housing adapted to engage the door frame to prevent rotation of said housing during tensioning of the counterbalance system, wherein said first stop surface is adapted to operate independent of the support brackets to prevent rotation of said housing during tensioning of the counterbalance system.

* * * * *